US005325961A

United States Patent [19]

Ford et al.

[11] Patent Number: 5,325,961

[45] Date of Patent: Jul. 5, 1994

[54] BLISTER PACKAGE FOR COSMETIC ARTICLE AND MEANS TO PROTECT APPLICATOR THEREFOR

[75] Inventors: John M. B. Ford; Kenneth Vilag; Tammye L. Byars, all of Cordova; Robin L. Turner, Memphis, all of Tenn.

[73] Assignee: Intellectual Property Holding Co., Wilmington, Del.

[21] Appl. No.: 908,057

[22] Filed: Jul. 6, 1992

[51] Int. Cl.[5] ..... B65D 69/00

[52] U.S. Cl. ..... 206/229; 132/317; 206/470; 206/471; 220/339

[58] Field of Search ..... 206/461, 467, 470, 229, 206/471; 132/317; 220/339

[56] References Cited

U.S. PATENT DOCUMENTS

| | | | |
|---|---|---|---|
| Re. 33,191 | 4/1990 | Matney . | |
| 2,445,685 | 7/1948 | Miles | 132/317 |
| 3,256,892 | 6/1966 | Esposito, Jr. | 220/339 X |
| 3,442,414 | 5/1969 | Pelli | 206/229 X |
| 3,519,128 | 7/1970 | Swanberg . | |
| 3,911,936 | 10/1975 | Kingsford . | |
| 4,060,173 | 11/1977 | Dahl | 220/339 X |
| 4,456,124 | 6/1984 | Kay et al. | 206/470 X |
| 4,469,226 | 9/1984 | Matney | 206/470 |
| 4,892,194 | 1/1990 | Garcia . | |

FOREIGN PATENT DOCUMENTS

| | | | |
|---|---|---|---|
| 1311848 | 3/1973 | United Kingdom | 220/339 |

*Primary Examiner*—Bryon P. Gehman

*Attorney, Agent, or Firm*—Sherman and Shalloway

[57] ABSTRACT

A blister package for a cosmetic article is disclosed which provides a means to include and protect an applicator while permitting the viewing of the cosmetic. The package comprises a support panel on which are mounted first and second blisters adapted to confine a cosmetic applicator and article, respectively. The first blister is mountable on the support panel confining the applicator and providing support for the cosmetic article while protecting the applicator from crushing and contamination. The second blister is mountable over the first blister, and the cosmetic article supported thereon, in a manner which allows the cosmetic article to be opened and the cosmetic therein viewed while preventing access to the cosmetic.

14 Claims, 5 Drawing Sheets

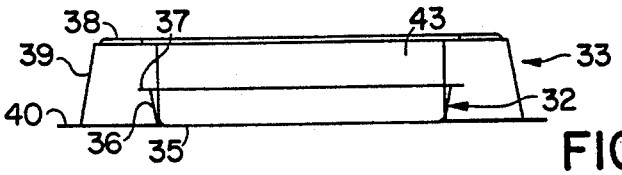
FIG. 9
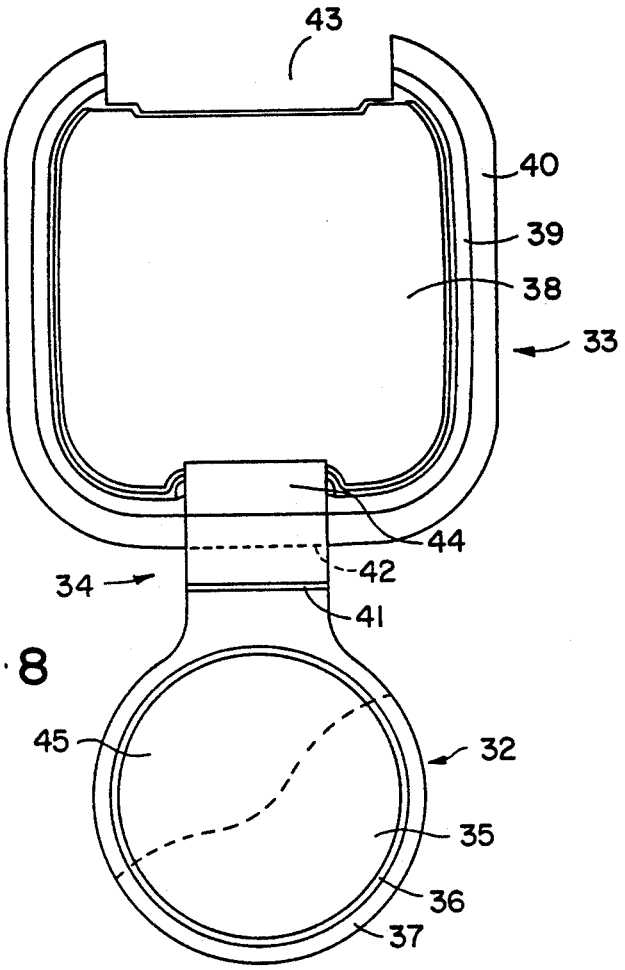
FIG. 8
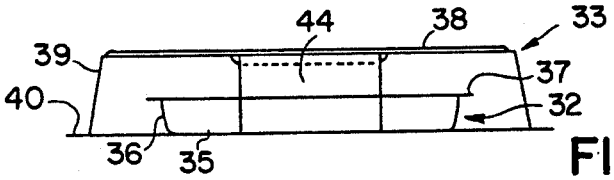
FIG. 10
FIG. 11
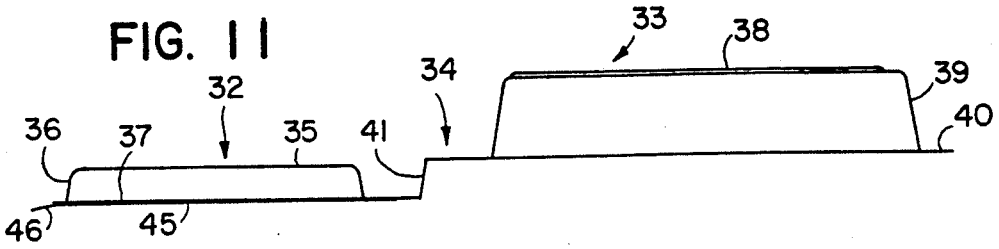

BLISTER PACKAGE FOR COSMETIC ARTICLE AND MEANS TO PROTECT APPLICATOR THEREFOR

BACKGROUND OF THE INVENTION

The present invention relates to a display package for a cosmetic compact and applicator which provides protection for both the cosmetic and an applicator means included therewith while permitting a prospective purchaser to view the actual cosmetic.

The packaging of three dimensional articles whereby the article is sealed within the packaging yet may be viewed by a prospective purchaser is well established. Specifically, with regard to cosmetic compacts containing face powder formulations, such packages include those of Swanberg, U.S. Pat. No. 3,519,128 and Matney, U.S. Pat. Re. 33,191. These packages provide a display card mounting means wherein the lower half of a compact is confined by a preformed blister which covers the cosmetic while the upper half or lid is allowed to pivot freely about its hinge.

The packages of the prior art are, however, deficient in their treatment of the applicator or puff which is commonly included with the powder compact. In most cases, such as that of Swanberg, the applicator is placed within the compact and partially covers the compressed powder cake thus obscuring it from view. In other cases, such as Mathey, the applicator is confined between the bottom of the compact and the display card and is often received by the purchaser in a crushed state.

It is essential in such packaging that the cosmetic be protected from contamination or other damage until ready for use by a purchaser and it is preferred that the applicator be likewise protected. It is also preferred that the applicator be maintained in a puffed and uncrushed state while within the packaging and the present invention provides a packaging which achieves these objectives.

SUMMARY OF THE INVENTION

The package of this invention comprises a solid support panel, a first preformed blister of thermoplastic material mounted on the support panel and confining a cosmetic applicator and a second preformed blister of thermoplastic material mounted on the support panel over and enclosing the first blister and confining a cosmetic compact between the first blister and the second blister. At least the second blister is sealed to the support panel by adhesive or heat sealing the bottom edges of the blister to the panel. The first blister may be likewise sealed to the panel.

In order that a prospective purchaser may view the contents of the compact without disturbing the package, the second blister is inserted between the top half of the compact and the bottom half thus allowing the compact to be opened and closed while the cosmetic cake therein remains covered and protected by the second blister. To accommodate the hinge and clasp means of the compact, the second blister is provided with notches or cutouts corresponding to the locations of the hinge and clasp.

The first blister provides protection for the cosmetic applicator or puff from dirt or other contamination as well as from crushing by the compact during assembly of the package or during shipping and storage. In so doing, the first blister supports the compact above the puff and may provide a means for centering the compact during assembly of the package.

In an alternative embodiment the first and second blisters are joined by means of an intervening section of thermoplastic material so as to be foldable relative to each other. In this manner the blisters are formable as a single unit and the first blister is folded so as to be within the confines of the second blister, the puff being within the first blister and the compact being supported thereon and confined by the second blister as in the first embodiment.

Accordingly, it is an object of this invention to provide a blister packaging means for a cosmetic compact which provides protection for both the cosmetic and the puff applicator while allowing a purchaser to view the cosmetic before purchase.

It is a further object to provide a package wherein the puff is positioned between the compact and a support panel and is protected against crushing by the compact.

It is a still further object to provide a package wherein the puff is confined within a first blister and the compact is confined within a second blister and wherein the first blister provides support for the compact within the second blister.

It is an even further object to provide a package for a powder compact and puff wherein the puff is protectively maintained beneath the compact by a first blister and the compact and first blister are confined by a second blister such that the cover of the compact is free to open or close while the powder cake remains covered and protected and is viewable through the second blister.

It is a still further object to provide such a package where the first and second blisters are joined to be foldable one within the other.

Further objects and advantages will become evident from the following drawings and description.

BRIEF DESCRIPTION OF THE DRAWINGS

FIG. 8 is a planar top view of the blister of the embodiment of FIG. 5 in an unfolded condition.

FIG. 9 is a rear elevation of the blister of FIG. 8 in a folded condition.

FIG. 10 is a front elevation of the blister of FIG. 8 in a folded condition.

FIG. 11 is a side elevation of the blister of FIG. 8.

DETAILED DESCRIPTION OF THE INVENTION

Figure 1:
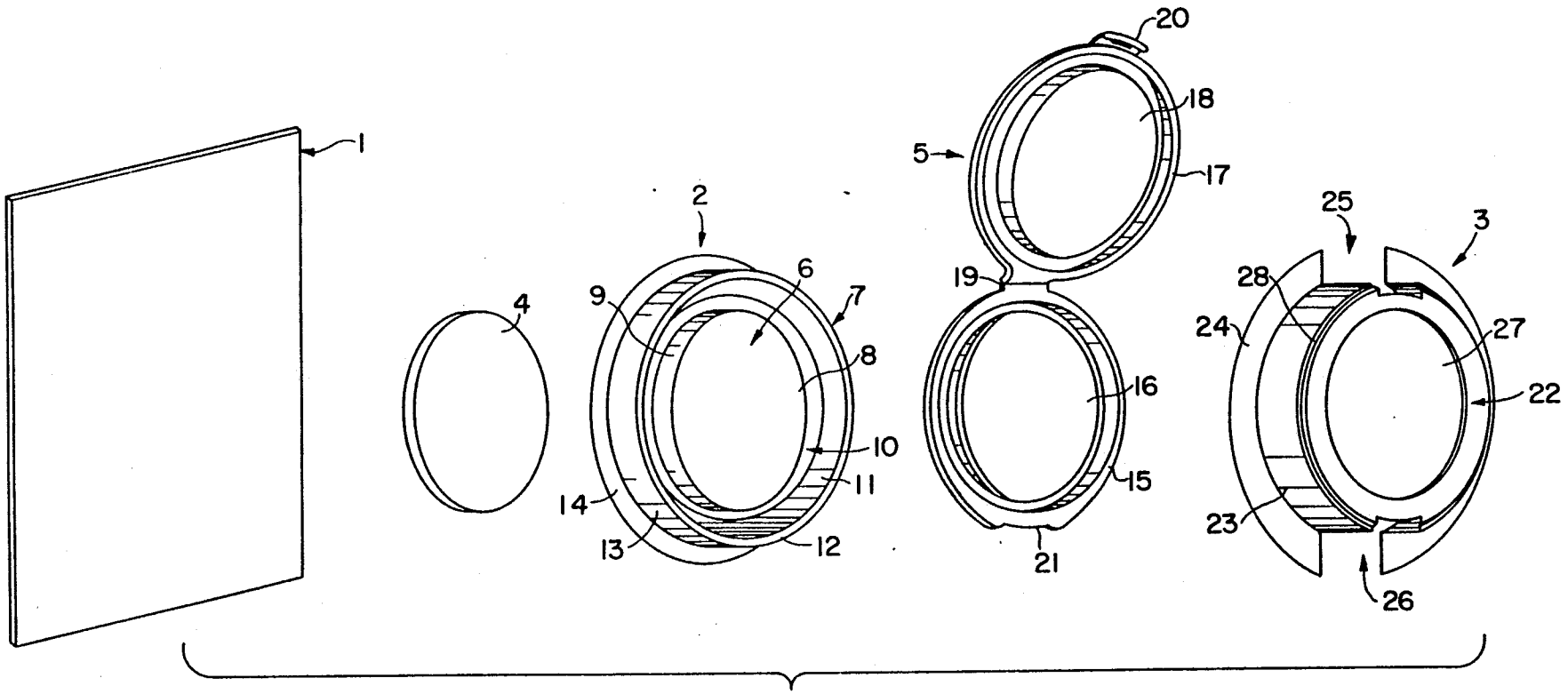
FIG. 1 is an exploded oblique view of a first embodiment of the present invention.
Figure 2:
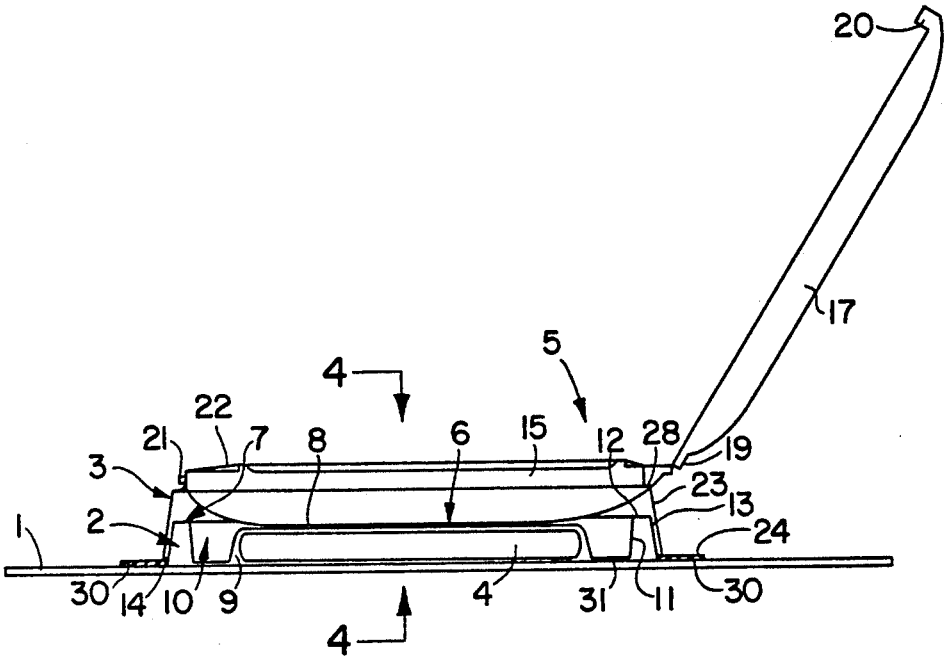
FIG. 2 is a side elevation of the package of the first embodiment with the hinged compact cover in the open position.
Figure 3:
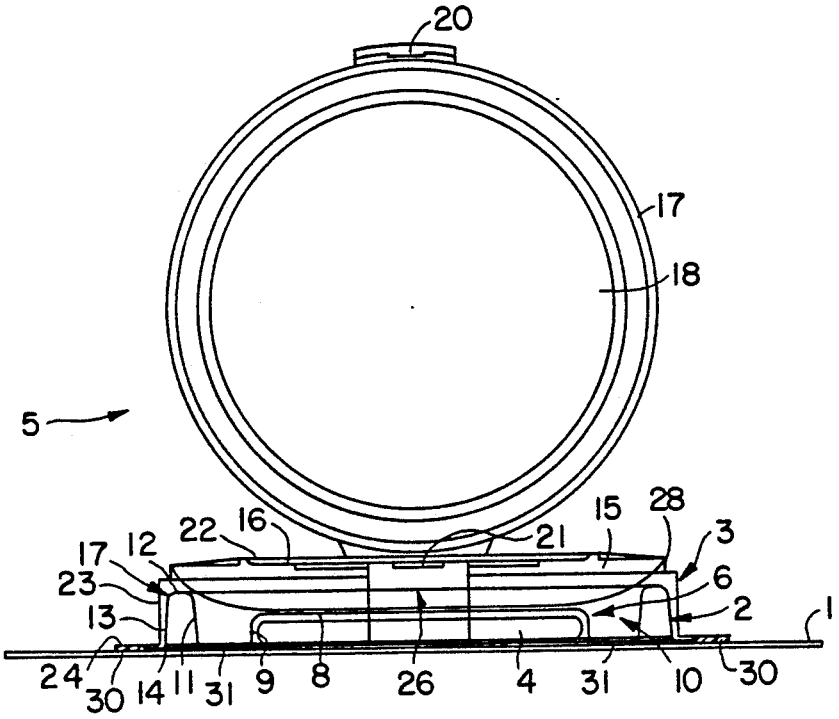
FIG. 3 is a front elevation of the package of FIG. 2.

As shown in FIG. 1, the package comprises a support panel 1, a first or powder puff blister 2 and a second or compact blister 3 which cooperate to confine a powder puff 4 and a cosmetic compact 5 in the relationship shown in FIGS. 2 and 3 wherein powder puff 4 is between the support panel 1 and first blister 2 and compact 5 is between first blister 2 and second blister 3. Support panel 1 is generally a rectangle of card stock or other suitable material having display indicia on at least one surface, preferably the surface to which the blisters are bonded. Support panel i may be of any desired shape or size as long as it provides a sufficient surface for secure bonding of the blisters which themselves are molded from a sheet of thermoformable material which is preferably a transparent thermoplastic, for example vinyl resin, olefinic plastic, and the like. Five gauge vinyl resin is commonly used for this purpose and has a thickness of between about 3 and 4 mils, although thicker or thinner blister material may be used.

Powder puff 4 is preferably circular in shape and is made from material having a soft texture and a fluffy consistency. Such powder puffs are well known and commonly packaged with cosmetic compacts for use as an applicator for the cosmetic. The powder puff may be of any desired shape but is usually circular even when the compact is another shape.

First blister 2 provides protection for the powder puff 4 as well as support for the compact 5 in the assembled package and comprises a sheet of thermoplastic material molded to form a central blister 6 to house powder puff 4 and support compact 5 as well as a circumferentially spaced wall 7 having a height slightly greater than that of central blister 6 and a general shape and dimension corresponding to that of compact 5. In the embodiment illustrated, blisters 2 and 3 as well as powder puff 4 and compact 5 are substantially circular in plan, thus the features of the blisters 2 and 3 will also be circular although other shapes may be employed. The open faces of blisters 2 and 3 are substantially identical to the outermost dimensions of powder puff 4 and compact 5 to provide for secure confinement therein.

Central blister 6 of first blister 2 comprises a horizontally planar wall 8 surrounded by a depending skirt 9. The height of skirt 9 corresponds substantially to the thickness of powder puff 4 while the diameter of planar wall 8 corresponds to the diameter of puff 4. In this manner, central blister 6 will have a configuration and size to completely confine powder puff 4 when placed against support panel 1. Circumferential wall 7 is spaced from central blister 6 by circumferential trough 10 such that the diameter formed by wall 7 is substantially equivalent to that of compact 5. The bottom of trough 10 provides a surface for contact with and adherence to support pane 11.

Wall 7 comprises inner skirt 11 extending from the bottom of trough 10 upwards a distance slightly higher than the height of central blister 6 to planar annular surface 12 from which depends outer skirt 13 extending downward a distance equal to inner skirt 11. Preferably a flange 14 is provided extending radially from the bottom edge of outer skirt 13 providing an additional surface for adherence to support panel 1. Preferably, wall 7 is of a height sufficient to contact the outer periphery of the bottom half 15 of compact 5 but not raise compact 5 out of contact with central blister 6. By forming wall 7 so that it is higher than central blister 6, wall 7 serves as lateral support for compact 5 and assists in centering of the compact on first blister 2 during automatic assembly of the package. Wall 7 also adds strength to first blister 2 to resist deformation during assembly, transportation and storage thus further protecting powder puff 4 against crushing by compact 5.

Like powder puff 4, compact 5 is well known and generally comprises a bottom half 15 in which is positioned a cosmetic 16, usually a pressed cake of face powder, and a top half 17 housing a mirror 18. Bottom half 15 and top half 17 are joined by a hinge means 19 so that top half 17 may function as a closure. The hinge means 19 may be any type of hinge construction commonly employed on cosmetic compacts including, but not limited to, molded live hinges, ball hinges, pintle hinges and the like. Diametrically opposite hinge means 19 on each half 15 and 17 of compact 5 are clasp portions 20 and 21 which cooperate to maintain compact 5 in a closed state until separated by a user. Similarly, the clasp means may be any type commonly used on cosmetic compacts including, but not limited to, cooperating snap detents, ball and hook clasps, and snap ball closures. When the package is assembled, bottom half 15 rests on wall 8 of central blister 6 and within the space bounded by wall 7 of first blister 2 and, with compact 5 open, second blister 3 is placed over compact 5 to cover cosmetic 16 and enclose both bottom half 15 of compact 5 and first blister 2 within which is confined powder puff 4.

Second blister 3 comprises a substantially circular horizontally planar wall 22 from which depends a circumferential skirt 23. Extending radially outwards from the bottom edge of skirt 23 is flange 24 by which second blister 3 is adhered to support panel 1. To accommodate hinge means 19 and clasp portions 20 and 21, second blister 3 is provided with diametrically opposed first and second openings or notches 25 and 26 cut into flange 24, skirt 23 and wall 22. As illustrated, first notch 25 accommodates hinge means 19 and second notch 26 accommodates clasp portions 20 and 21. Notches 25 and 26 extend into wall 22 only so far as is necessary to accommodate and permit the working of hinge means 19 and clasp portions 20, 21 and in any event do not extend so far in toward the center of wall 22 as would expose any portion of cosmetic 16. Where necessary, due to the particular design of the interior of compact 5, wall 22 may be provided with moldings to facilitate the closing of top half 17 over bottom half 15 of compact 5. In this particular instance a circular depressed area 27 is provided corresponding to the positions of cosmetic cake 16 and mirror 18 and the perimeter of wall 22 is given a step 28 to accommodate the closing edges of top half 17 and bottom half 15 of compact 5.

FIGS. 2 and 3 illustrate the package in its assembled state with top half 17 of compact 5 open. As these figures show, powder puff 4 is confined within central blister 6 by support panel 1 with the wall 8 providing a support shelf for bottom half 15 of compact 5. Wall 7 provides lateral support for compact 5 as well as centering of compact 5 on central blister 6. Second blister 3 fits over bottom half 15 of compact 5 and encloses bottom half 15, first blister 2 and powder puff 4. Hinge 19 is free to operate through first notch 25 while clasp portions 20, 21 are permitted to engage through second notch 26. Preferably, both flange 14 of first blister 2 and flange 24 of second blister 3 are adhered to support panel 1 by any suitable means such as adhesive or heat sealing as at 30. In addition, as mentioned previously, the bottom of trough 10 may also be so adhered to support panel 1 as at 31.

Figure 4:
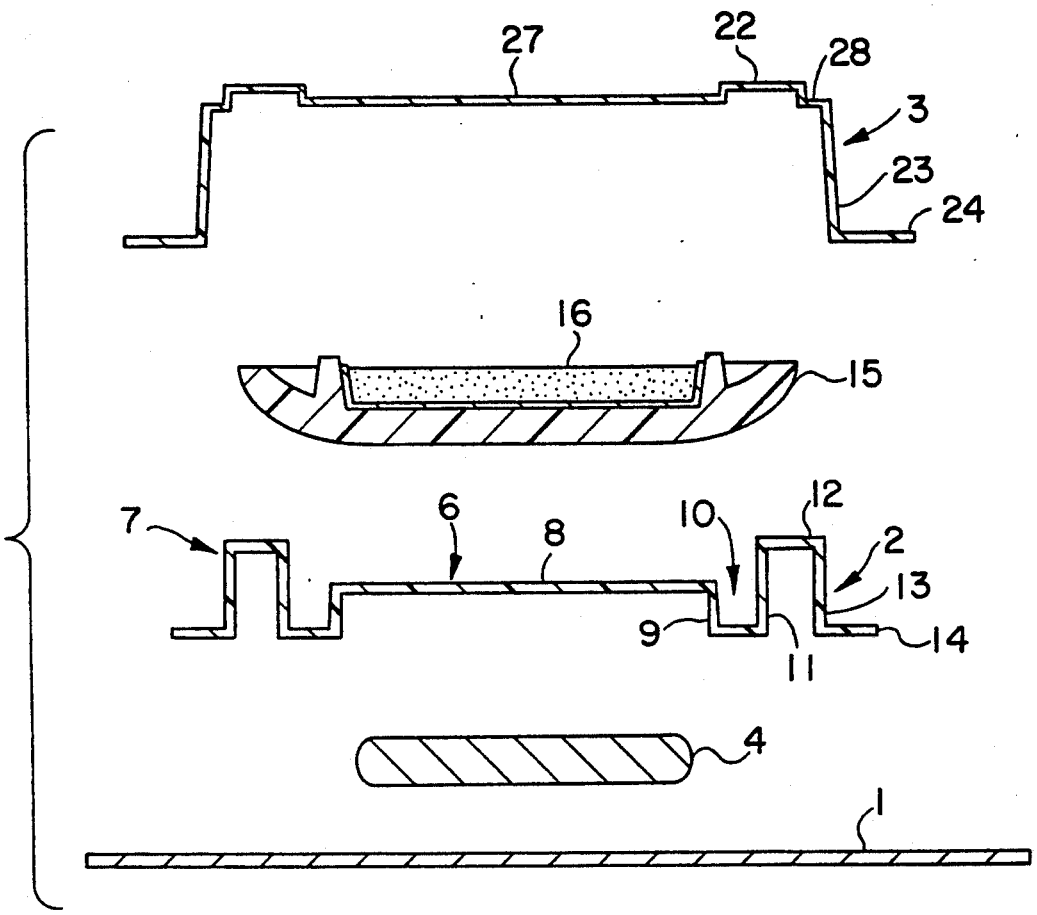
FIG. 4 is an exploded cross section of the package of FIG. 2 taken along line 4—4.

FIG. 4 is an exploded cross section of FIG. 2 taken along line 4—4 and shows in larger scale the relationship of support panel 1, first blister 2, second blister 3, powder puff 4 and bottom half 15 of compact 5. Top half 17 of compact 5 has been omitted for clarity.

Figure 5:
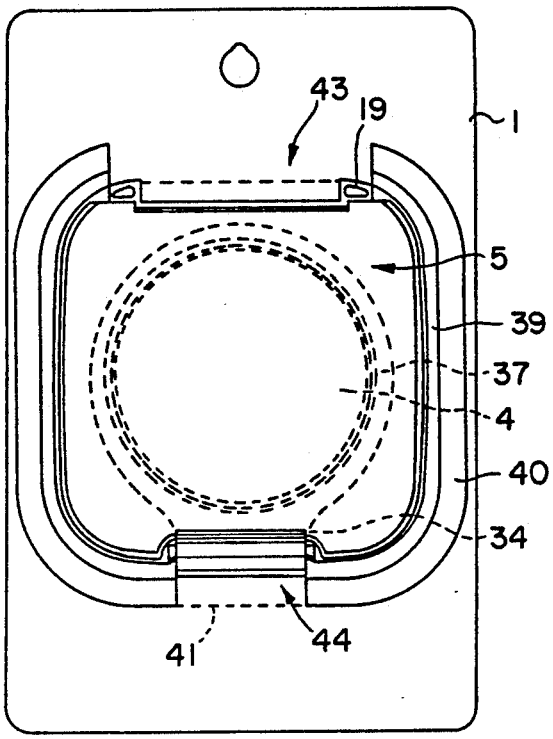
FIG. 5 is a planar top view of the package of a second embodiment of the present invention.
Figure 6:
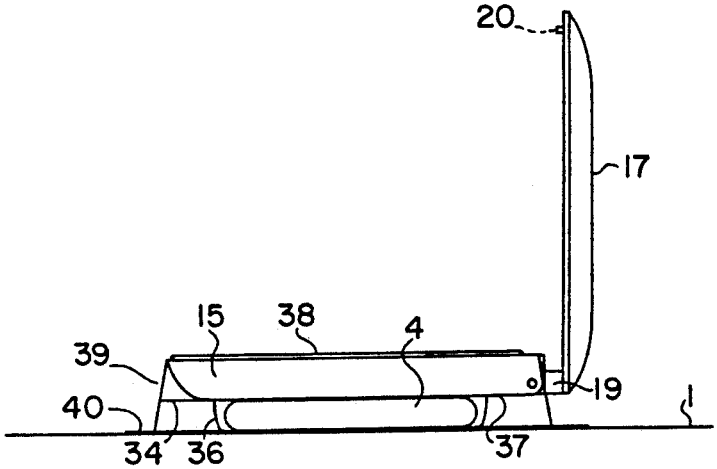
FIG. 6 is a side elevation of the package of FIG. 5 with the hinged compact cover in the open position.
Figure 7:
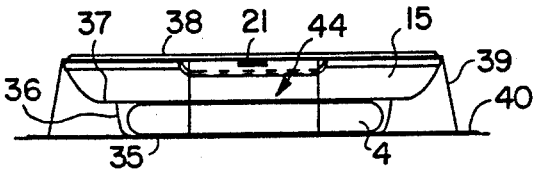
FIG. 7 is a front elevation of the package of FIG. 5.

Whereas the first embodiment presents the package of the invention with first and second blisters 2 and 3 being formed as separate elements and sequentially assembled to form the complete package, it is within the scope of this invention to form the blisters as portions of a single element. FIGS. 5 through 11 illustrate the package with such an embodiment, the two blisters being formed from one piece of material as an integral molding. In this instance, FIGS. 5 through 7 illustrate the completed package while FIGS. 8 through 11 illustrate a blister molding in accordance with this embodiment.

Turning first to FIG. 11, it is seen that the unit molded blister comprises first blister 32 and second blister 33 joined by an intervening section 34 of material. First blister 32 provides a housing for a powder puff 4 and comprises a planar horizontal wall 35 with a depending circumferential skirt 36. About the bottom edge of the skirt 36 is a radially extending flange 37. Similarly, second blister 33, which provides a housing for cosmetic compact 5, comprises a substantially planar horizontal wall 38, a depending circumferential skirt 39 and a surrounding radial flange 40. Skirt 39 is of sufficient height to permit second blister 33 to accommodate first blister 32 and bottom half 15 of compact 5 when the package is assembled with flange 40 bonded to support panel 1. In this embodiment, whereas first blister 32 is circular in form to accommodate a normal powder puff, second blister 33 is depicted in a rectangular form and accommodating a rectangular compact 5. It should be noted that either blister may be formed in any desired shape, the only determining factor being the shape of the powder puff or compact to be packaged therein. As with the first embodiment, the open faces of first and second blisters 32, 33 are substantially identical to the outer dimensions of powder puff 4 and compact 5.

Looking at FIGS. 8 and 11, it is seen that intervening section 34 unites blisters 32 and 33 and is, in effect, an extension between the respective flanges 37 and 40. To permit first blister 32 to fold into the area defined by second blister 33 and thereby form the blister structure shown in FIGS. 9 and 10, section 34 is provided with an offset 41. This offset 41, resulting in a vertical displacement of first blister 32 relative to second blister 33 as shown in FIG. 11, allows first blister 32 to extend upward into second blister 33 when folded along line 42 which corresponds to the continuance of the edge of flange 40 through the area of strip 34 where it connects to second blister 33. Line 42 also represents a score in the material from which the blisters are formed, this score serving to facilitate folding of first blister 32 relative to second blister 33 about line 42. The score may be made at the same time the blisters are formed or as a separate step. Offset 41 also allows flange 40 to present a substantially uniformly planar surface for bonding to support panel 1. In the illustrated embodiment first and second blisters 32, 33 are both formed with their open faces on the same side; in this manner, first blister 32 will provide an upwardly opening cup, when folded into place relative to second blister 33, in which powder puff 4 will be placed. Flange 37, together with skirt 36, will provide the support for compact 5 resting on first blister 32 while wall 35 may be used to secure first blister 32 to support panel 1. The depth of first blister 32 as defined by skirt 36 is sufficient so that compact 5 will be supported above powder puff 4 thus preventing puff 4 from being crushed between compact 5 and support panel 1. Alternatively, first and second blisters 32, 33 may be formed with their open faces opposed so that both will be closed by support panel 1 and wall 35 of first blister 32 will serve as a support shelf for compact 5 in the completed package.

As in the first embodiment, second blister 33 is provided with means to accommodate hinge 19 and clasp portions 20, 21 of compact 5 so that compact 5 may be opened and the cosmetic cake 16 viewed through wall 38 of blister 33. These means comprise a first notch 43 through flange 40, skirt 39 and wall 38 in the side of blister 33 opposite that to which intervening section 34 is connected. This first notch 43 accommodates hinge 19 of compact 5. First notch 43 extends into wall 38 only so far as is necessary to accommodate and permit the working of hinge 19. A second notch 44 is provided in the opposing side of blister 33 and adjacently opposite intervening strip 34. Second notch 44 is cut into skirt 39 and wall 38 as with first notch 43, but does not extend into flange 40 thereby retaining the attachment of strip 34. Clasp portions 20 and 21 of compact 5 cooperate by passing through second notch 44. Alternatively, the unitary molded blisters of this embodiment may be formed so that first blister 32 is attached to second blister 33 by intervening section 34 along an edge of second blister 33 intermediate first and second notches 43, 44 in which case second notch 44 may be cut through flange 40 as with first notch 43. First blister 32 would still be foldable into second blister.

Looking at FIGS. 5 through 7, it can be seen that this embodiment provides a package of the same type as that of the first embodiment with powder puff 4 confined by first blister 32 so as to be beneath the bottom half of compact 5 which is itself confined within second blister 33. In this manner, powder puff 4 is protected from dirt and contamination by first blister 32. Furthermore, compact 5 is openable by a prospective purchaser for viewing the cosmetic therein while the cosmetic too remains protected by second blister 33. Additionally, first blister 32 provides support for compact 5 to resist the tendency to crush powder puff 4 positioned between compact 5 and support panel 1.

As described previously, first blister 32 forms a cup when folded into second blister 33. In its illustrated form, wall 35 abuts support panel 1 and may be adhered thereto by heat sealing, RF or by any suitable adhesive and forms an upwardly opening cup in which powder puff 4 is placed. Open compact 5 is positioned over puff 4 and is supported by flange 37 and skirt 36 of first blister 32. Compact 5 is properly oriented so that hinge 19 and clasp portions 20, 21 will be in registration with notches 43 and 44 of second blister 33. Second blister 33 is then closed over the combination of first blister 32, puff 4, and bottom half 15 of compact 5 by folding intervening section 34 at line 42. Flange 40 of second blister 33 is bonded to support panel 1 by suitable means such as heat sealing, RF or adhesive, and top half 17 of compact 5 is closed over second blister 33. As with second blister 3 of the first embodiment, second blister 33 may also have features molded into horizontal wall 38 to accommodate the structure of the opposing faces of top half 17 and bottom half 15 of compact 5.

Alternatively, the unit molded blisters of the second embodiment may be formed so that first blister 32 will trap powder puff 4 between support panel 1 and first blister 32 with wall 35 then forming a shelf on which compact 5 will rest in the same manner as central blister 6 of the first embodiment. In such an alternative, first blister 32 may be formed with the structure of first blister 2 thereby providing both powder puff protection and centering means for compact 5. A further alternative will be to provide an intervening strip 34 between first blister 2 and second blister 3, their open faces being opposite so that upon assembly of the package they will both face support panel 1.

In a still further alternative, applicable to both embodiments described herein, powder puff 4 may be presealed within first blister 2 or 32 by means of a sheet 45 of flexible material, such as Mylar, cellulose, saran or other thin plastic or metal foil, or the like, placed over the open face of first blister 2 or 32 and sealed by heat sealing, adhesive, or other appropriate means to flanges 14 or 37. A tab 46 provides a means for grasping and peeling the sheet 45 from first blister 2 or 32. Alternatively, sheet 45 may be simply pierced and torn away by the user. In this manner, blisters and powder puffs may be easily handled and the package assembled without the risk of powder puffs becoming inadvertently displaced or lost.

Although illustrative embodiments of the present invention have been described herein with reference to the accompanying drawings, it is to be understood that the invention is not limited to those precise embodiments, and that various changes and modifications may be effected therein by one skilled in the art without departing from the scope or spirit of the invention.

What is claimed is:

1. A display package for a cosmetic article, which comprises:

a support panel having a first surface;

a first preformed blister formed from a transparent thermoformable material and mounted on said first surface of said support panel and adapted to confine a cosmetic applicator, said first blister comprising a first horizontal wall, a first peripheral skirt depending substantially perpendicularly from the periphery of said first wall and a first flange extending radially outward from the lower edge of said first skirt whereby said first blister is mounted on said support panel; and a second preformed blister formed from a transparent thermoformable material and mounted over said first preformed blister on said first surface of said support panel and enclosing said first preformed blister, said second blister comprising a second horizontal wall, a second peripheral skirt depending substantially perpendicularly from the periphery of said second wall and a second flange extending radially outward from the lower edge of said second skirt beyond the perimeter of said first flange of said first blister whereby said second blister is mounted on said support panel;

wherein said first preformed blister further comprises a central blister portion having a horizontal top wall and a depending circumferential side wall, a circumferential trough about said central blister portion and a circumferential outer wall about said trough, said outer wall having means for mounting said first preformed blister to said support panel; whereby said central blister portion comprises means to confine a cosmetic applicator; and whereby said first preformed blister and said second preformed blister define an area therebetween which is adapted to confine a cosmetic article, and whereby said first preformed blister comprises a support for a cosmetic article in said package.

2. The display package of claim 1, further comprising a cosmetic article comprising a powder compact and a cosmetic applicator comprising a powder puff.

3. The display package of claim 2, wherein said second preformed blister further comprises first and second opposing notches in said skirt and said flange.

4. The display package of claim 3, wherein said cosmetic article is a powder compact comprising top and bottom halves having a hinge therebetween and having a clasp opposite said hinge, wherein said bottom half is confined between said first and second preformed blisters, said hinge passes through said first notch and said clasp engages through said second notch.

5. The display package of claim 2 further comprising means to closed said first preformed blister whereby said cosmetic applicator is releasably sealed within said first preformed blister.

6. The display package of claim 5 wherein said means to close said first preformed blister comprises a sheet of flexible material placed over the open face of said first blister and adhered to said flange of said first blister in a manner to be removable therefrom.

7. A display package for a cosmetic article comprising:

a support panel having a first surface; and a preformed blister formed from a transparent moldable sheet material and mounted on said first surface of said support panel, said blister comprising a first smaller blister portion comprising a substantially planar horizontal wall and a depending circumferential skirt, and a second larger blister portion comprising a substantially planar horizontal wall and a depending circumferential skirt, wherein said first blister portion is joined to said second blister portion by an intervening strip of said sheet material, said intervening strip providing a hinge between said first blister portion and said second blister portion whereby said first blister portion is foldable relative to said second blister portion from a first position within said second blister portion whereby said first blister portion is confined between said second blister portion and said support panel;

said display package further comprising a cosmetic article and a cosmetic applicator pad wherein said first blister portion comprises means to confine said cosmetic applicator pad and said second blister portion comprises means to confine said cosmetic article, said cosmetic article comprising a housing containing at least one quantity of a cosmetic, said first blister portion being foldable relative to said second blister portion whereby said applicator pad is confined between said first blister portion and said cosmetic article;

wherein said preformed blister is mounted to said support panel such that said first blister portion and said cosmetic applicator pad are confined within aid second blister portion between said first surface of said support panel and said cosmetic article; and wherein said second blister portion further comprises opposing first and second openings in said depending skirt of said second blister portion.

8. The display package of claim 7 wherein said cosmetic article is a powder compact comprising top and bottom housing halves joined along one edge by a hinge for relative movement between open and closed positions and having a clasp along an edge opposite said hinge for maintaining said housing halves in a closed position; wherein said bottom half of said compact is confined within said second blister portion between said second blister portion and said first blister portion such that said top half is outside of said second blister portion, and wherein said hinge passes through one of said opposing first and second openings in said second blister portion and said clasp engages through the other side of said opposing first and second openings.

9. The display package of claim 8, wherein said transparent moldable sheet material is a thermoplastic.

10. The display package of claim 7 further comprising means to close said first preformed blister portion whereby said cosmetic applicator pad is releasably sealed within said first blister portion.

11. The display package of claim 10 wherein said means to close said first blister portion comprises a sheet of flexible material spanning an area bounded by said skirt opposite said horizontal wall of said first blister portion and adhered thereto in a manner to be removable therefrom.

12. A display package for a cosmetic article comprising:

a support panel having a first surface; and a preformed blister formed from a transparent moldable sheet material and mounted on said first surface of said support panel, said blister comprising a first smaller blister portion comprising a substantially planar horizontal wall and a depending circumferential skirt, and a second larger blister portion comprising a substantially planar horizontal wall and a depending circumferential skirt, wherein said first blister portion is joined to said second blister portion by an intervening strip of said sheet material, said intervening strip providing a hinge between said first blister portion and said second blister portion whereby said first blister portion is foldable relative to said second blister portion from a first position adjacent to said second blister portion to a second position within said second blister portion whereby said first blister portion is confined between said second blister portion and said support panel;

said display package further comprising a cosmetic article and a cosmetic applicator pad wherein said first blister portion comprises means to confine said cosmetic applicator pad and said second blister portion comprises means to confine said cosmetic article, said cosmetic article comprising a housing containing at least one quantity of a cosmetic, said first blister portion being foldable relative to said second blister portion whereby said applicator pad is confined between said first blister portion and said support panel within said second blister portion and wherein said cosmetic article is confined between said first blister portion and said second blister portion;

wherein said cosmetic article comprises a powder compact having top and bottom halves joined along one edge by a hinge for relative movement between open and closed positions and having a clasp along an edge opposite said hinge whereby said top and bottom halves are maintainable in a closed condition and wherein said bottom half is confined within said second blister portion such that said top half is outside of said blister, said second blister portion having means permitting passage of said hinge and said clasp through said second blister portion.

13. The display package of claim 12, wherein said means permitting passage of said hinge and said clasp comprises opposed openings in said depending skirt of said second blister portion.

14. The display package according to claim 13, wherein said transparent moldable sheet material is a thermoplastic.

* * * * *